US005159333A

United States Patent [19]

Wolski

[11] Patent Number: 5,159,333

[45] Date of Patent: Oct. 27, 1992

[54] SECURE CODE OPERATED DEVICE

[75] Inventor: Raymond A. Wolski, New Britain, Conn.

[73] Assignee: Raymond Engineering Inc., Middletown, Conn.

[21] Appl. No.: 233,029

[22] Filed: Aug. 16, 1988

[51] Int. Cl.[5] ..... G08C 19/00

[52] U.S. Cl. ..... 340/825.57; 340/825.31; 340/825.34

[58] Field of Search ..... 340/825.31, 825.34, 340/825.57, 825.62, 825.65, 543; 70/278, 315; 102/262

[56] References Cited

U.S. PATENT DOCUMENTS 2,915,013 12/1959 Moorhead et al. .
3,017,761 1/1962 Pleterski .
3,058,095 10/1962 Reynolds ..... 340/825.62
3,368,487 2/1968 Oconnor et al. .
3,508,202 4/1970 Joel, Jr. .
3,584,486 6/1971 Trip et al. .
3,622,991 11/1971 Lehrer et al. .
3,745,798 7/1973 Pieddeloup .
3,832,873 9/1974 Barnette ..... 70/315 X
4,019,441 4/1977 Morgen et al. .
4,099,161 7/1978 Wolski .
4,333,073 6/1982 Caruso .
4,408,188 10/1983 Caruso ..... 340/825.31

*Primary Examiner*—Ulysses Weldon
*Attorney, Agent, or Firm*—Fishman, Dionne & Cantor

[57] ABSTRACT

A secure coding device is presented that requires a multi-bit binary code to rotate a locking cam to an unlock position. The device is secure against unauthorized human intervention because it does not provide information to an attempted intervenor which can be used to further attempt to gain access to the system.

23 Claims, 6 Drawing Sheets

SECURE CODE OPERATED DEVICE

BACKGROUND OF THE INVENTION

This invention relates to the field of coding devices. More particularly, this invention relates to a coding device which is secure against unauthorized attempts to operate the device by human intervention.

Code operated devices are used for a variety of applications. One important application for code operated devices is for SAFE and ARM mechanisms for various kinds of missiles and other weapons. Such devices involve the use of codes to prevent arming of a weapon system unless a predetermined code has been satisfied. Coded SAFE and ARMING devices are particularly important for use with nuclear weapons, although their utility is by no means limited to such weapons.

A prior art electromagnetic code operated device is described in U.S. Pat. No. 4,099,161 granted to the present inventor and assigned to the assignee hereof (the subject matter of which is incorporated herein by reference). The device of that prior patent is an effective code operated device for a weapon or other system. In the environment of a weapon system, it operates to effect a change from a SAFE state to an ARMED state in response to receipt of a predetermined code in an appropriate signal input sequence. In the event an improper code is received, the device of that prior patent will lock to a DUD state, and the device will not advance further toward the ARMED state.

While effective for its intended purposes, the feature of the system of the U.S. Pat. No. 4,099,161 wherein it locks to a DUD state in response to receipt of an improper code can, if sufficient time is available, be used by a knowledgeable individual to work through the code to unlock and gain unauthorized access to the system. The system of the prior patent operates on a code of binary "0" and "1" inputs. If the proper code is delivered, the device will "unlock" to permit operation of the protected mechanism (missile, weapon, etc.); but the code wheel locks if an improper code sequence is delivered. Thus, if a "1" is inputted at the place in the code where an "0" is the proper input (or vice versa), the device will lock to the DUD state. However, while this locking prevents any further advance to the unlocked state, it will tell a knowledgeable person that the wrong binary signal was used at the place in the input signal string. Thus, a knowledgeable person will know that there is always a 50-50 chance of correctly guessing each succeeding bit in a code; and if the system locks because of an incorrect input, that person will know that the lock state can be avoided at this place in the input signal string by using the complementary binary input at that place. Thus, it may be possible to work through the code and unlock the device by (1) inputting a string of binary signals until the device locks,
(2) resetting the device to the start position and repeating the previous string of input signals with the last one (i.e. the one that caused the system to lock) being changed to the opposite binary state,
(3) continuing to input signals until another lock state is encountered, and
(4) repeating steps (2) and (3) until the enter code is worked through and the device unlocks.

Thus, while the device of U.S. Pat. No. 4,099,161 is a coded safety device, it is not considered a secure device in the sense that it is protected against reasoned human intervention. With a binary code it is, of course, statistically possible that someone could randomly guess the correct code. While the probabilities of that happening are very low, there does not appear to be any way to make a device secure against that remote possibility. However, it is highly desirable to make coded safety devices secure in the sense of protecting them against attempts at reasoned human intervention.

SUMMARY OF THE PRESENT INVENTION

Although the device of the present invention will be described in connection with a SAFE and ARM device for weapons, it will be understood that its use is not limited to that application. In its broadest sense, the device of the present invention may be considered to be a secure coded locking device, and it may be used for any application which requires limitation to only authorized access or in which it is desired to unlock any mechanism or to generate an output signal such as mechanical movement in response to the receipt of an appropriate input signal code. Examples of uses other than weaponry include, but are not limited to, control of access to restricted areas, control of access to computer systems, control of operation of power plants. Regardless of the application, the operation of the device and its output may be viewed as generating an output or signal when the proper code is inputted to the device. In the context of the present invention, a secure coded device will be understood to be one which does not provide information to an attempted intervenor which can be used to further the attempt to gain access to the system.

In accordance with the present invention, a drive mechanism operates through coded sensors to provide an output signal (which may be to unlock a previously locked mechanism) upon receipt of a predetermined unique coded input signal. The device is made secure by means of "0" and "1" input code cams and a pair of input control cams which are each connected to and drive separate code and control output cams. Each operating signal, whether in the correct code or not, will cause the input control cam and its associated output cam to step or advance one unit. However, the input code cam and associated output cam will only advance if the properly coded signal has been delivered to operate the device; and they will not advance if the proper code signal has not been inputted. The output cams are each provided with operating means to unlock or otherwise provide an output signal if the cams are both moved synchronously to their actuating position with the operating means aligned or in other predetermined relationship (which occurs if the proper code sequence has been delivered to the device). Proper alignment (or other relationship) between the operating means defines an operating window. However, if the incorrect code is delivered to the device (on either the "0" input channel or the "1" input channel), the input code cam to which the incorrect signal has been delivered will not advance, but the associated input control cam will advance. This advance of the input control cam will cause the control output cam to advance and thus misalign or scramble the operating means on the two output cams; and that state of misalignment will continue to exist even if the remainder of the code inputted to the device is correct. This misalignment occurs in a single step i.e., in response to a single erroneous input. The misalignment of the operating means operates, in effect, to close the operating window of the device to prevent actuation of an unlocking device. Because of the misalignment and closure of the operating means in the two output cams, the output signal (e.g. unlocking of a locked device) will not occur. The operating means may e.g., be notches, other contours, electrical contact points, etc. on the output cams. The preferred system disclosed herein uses notches.

Unlike the device of prior U.S. Pat. No. 4,099,161 which locks when an erroneous signal is inputted, the device of the present invention is disabled from generating an output signal, but operation does not lock. Thus, the device of the present invention is secure against intentional unauthorized intervention because it does not give any signal to the intervenor that a wrong signal has been inputted. The intervenor does not learn when a wrong signal has been inputted, so the intervenor cannot work through the system in a series of locking, resetting and unlocking steps. Rather, the intervenor will continue to deliver input signals to the device without knowing that a wrong signal has been delivered and that the required synchronism of the output cams has been scrambled.

Other features and advantages of the secure code operated device of present invention will be apparent to and understood by those skilled in the art from the following detailed description and drawings.

BRIEF DESCRIPTION OF THE DRAWINGS

Referring now to the drawings wherein like elements are numbered alike in the several figures.

DESCRIPTION OF THE PREFERRED EMBODIMENTS

Figure 1A:
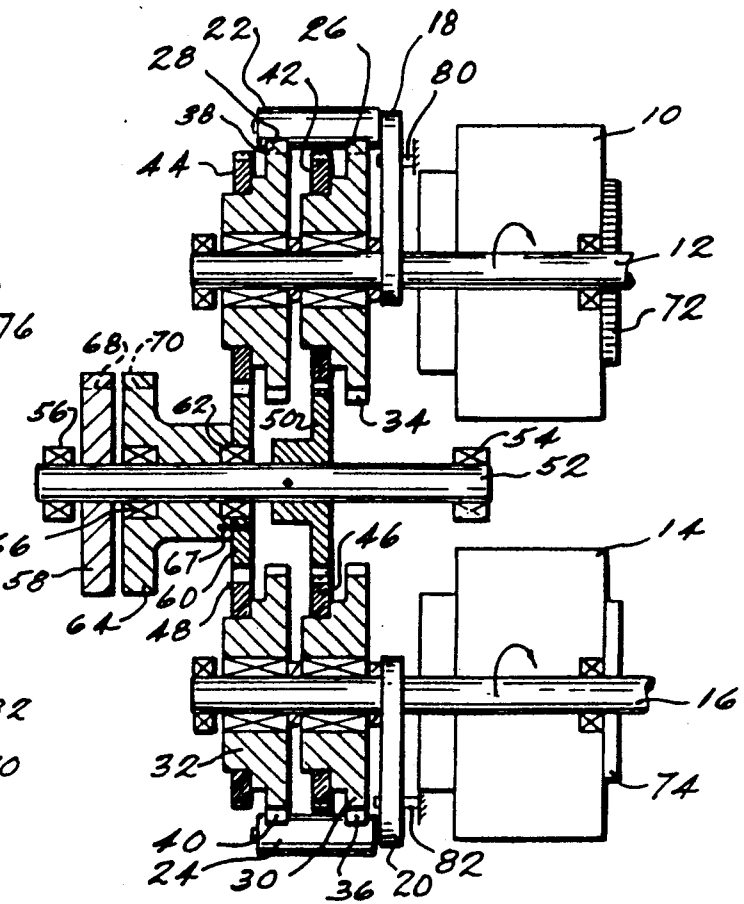
FIG. 1*a* shows a first version of the secure code operated device of the present invention
Figure 1B:
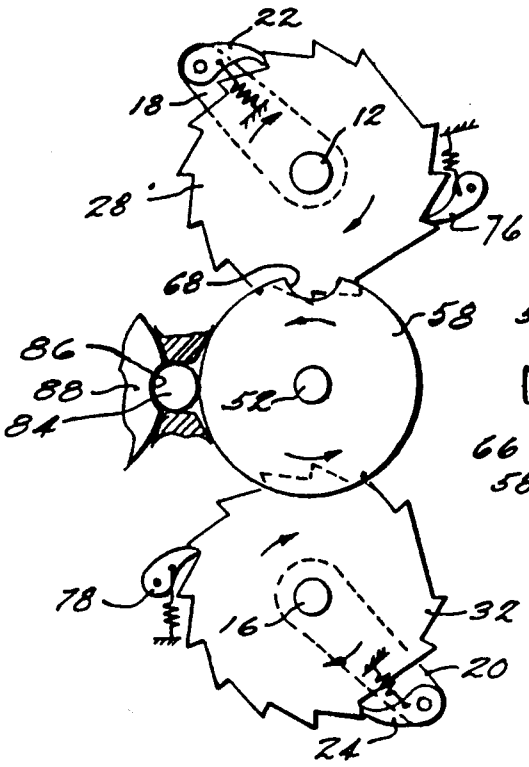
FIG. 1*b* is an illustration of the relationship of input and output cams of the device of FIG. 1*a*
Figure 1C:
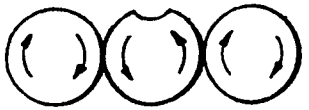
FIG. 1*c* illustrates relative rotation senses of input and output cams

Referring first to FIGS. 1*a*, 1*b* and 1*c*, a first embodiment of the secure code operated device of the present invention is shown. Although not all supporting framework is shown, it will be understood that the device of the present invention is enclosed and suitably supported in a housing and is, preferably, environmentally sealed. In this first embodiment, first driver solenoid 10 drives a first rotatable shaft 12, and a second driver solenoid 14 drives a second shaft 16. Solenoid 10 and its shaft 12 are in the "0" bit channel, and solenoid 14 and shaft 16 are in the "1" bit channel of a binary code input. A pawl driver arm 18 is fixed to shaft 12 to move about the axis of shaft 12 when shaft 12 is rotated, and a pawl driver arm 20 is fixed to shaft 16 to move about the axis of shaft 16 when shaft 16 is rotated. A "0" bit drive pawl 22 is pivotally connected to arm 18, and a "1" bit drive pawl 24 is pivotally connected to arm 20. The shafts 12 and 16 and the pawl arms 18 and 20 will rotate by a set amount for each input to their respective solenoid drives 10 and 14.

A pair of cams is rotatably mounted on each of shafts 12 and 14. A control cam 26 and a "0" bit input code cam 28 are rotatably mounted on bearings about shaft 12, and a control cam 30 and a "1" bit input code cam 32 are rotatably mounted on bearings about shaft 16. Code cams 28, 32 (e.g. which function as mechanical means of storing the code) are shown partly broken away in FIG. 1*b* for convenience of illustration. Each of control cams 26 and 30 has a series of ratchet teeth 34 and 36 spaced equally about the entire periphery of cams 26 and 30. The number and spacing of teeth 34 and 36 will depend on the desired number of bits in the operating code and the resolution of the output cams (i.e., the ability of the mechanism to recognize and find the unlocking notches). While full cams of ratchet teeth 34, 36 may preferably be employed, it is not necessary that the ratchet teeth extend around the entire control cams 26, 30; but the ratchet teeth 34 and 36 must be equally spaced apart on the periphery of control cams 26 and 30 for whatever span they occupy and they must occupy corresponding coordinated spans on the respective control cams. Each of the input code cams 28 and 32 also has ratchet teeth 38 and 40, respectively, spaced about the periphery of the code cams. However, these code teeth are not equally spaced about the entire periphery of the code cams. Rather, these code teeth are spaced apart about the periphery of their respective code cams so as to be commensurate with the code for which the device is set to operate. Since the system operates on a binary code, at each corresponding position of the code cams 28 and 32 the ratchet tooth state is complementary. That is, if there is a ratchet tooth present at a particular position on the "0" bit code cam, then there will be no ratchet tooth at the corresponding position on the "1" bit code cam, and vice versa. Pawls 22 and 24 span their respective control and code cams 26, 28 and 30, 32 to contact the ratchet teeth 34, 38 and 36, 40 and incrementally drive both cams (assuming the code input is correct).

Since the control cams have teeth around their entire peripheries, each control cam will always advance one step for each cycling of its respective pawl driver and pawl (i.e. in response to either a "0" input signal to solenoid 10 or a "1" input signal to solenoid 14). However, the "0" bit input code cam 28 will advance only if there is ratchet tooth present at the position of the code cam when the pawl and pawl drive are cycled in response to an input signal to "0" bit solenoid 10; and, similarly, the "1" bit input code cam 32 will advance only if there is a ratchet tooth present at the position of the code cam when the pawl and pawl drive are cycled in response to an input signal to "1" bit solenoid 14. The fact the control cams advance for each cycling but the code cams do not is an important feature in making the device of the present invention a secure coded device.

Gears 42 and 44 are secured, respectively, to reduced diameter hub sections of control cam 26 and code cam 28; and gears 46 and 48 are secured, respectively, to reduced diameter hub sections of control cam 30 and code cam 32. Gears 42 and 46 mesh with and drive an output gear 50 which is secured to and drives an output shaft 52. Shaft 52 is supported by bearings 54 and 56. A control output cam 58 is also secured to and rotates with output shaft 52. Since shaft 52 and output cam 58 are drivingly connected to both of the control cams 26 and 30, and since one or the other of those control cams will be advanced one step for either a "0" or a "1" bit input signal, shaft 52 and output cam 58 will always rotate one step for a signal bit input, regardless of the digital state of the input signal bit.

Gears 44 and 48 mesh with a gear 60 which is supported on shaft 52 by a bearing 62, gear 60 being free to rotate relative to shaft 52. A code output cam 64 is also rotatably mounted on shaft 52 by a bearing 66, and output cam 64 ,is pinned or otherwise locked to gear 60 as at pin 67 so that gear 60 and output cam 64 rotate in unison. Because gear 60 is drivingly connected to code cams 28 and 32, gear 60 and output cam 64 will each advance one step whenever a "0" input signal is delivered to solenoid 10 or a "1" input signal is delivered to solenoid 14. Each pulse to a solenoid driver causes a fixed advance step rotation of its associated pawl driver and pawl. The amount of angular rotation is determined by the number of ratchet teeth on the code and control cams. For example, with 48 teeth spaced evenly about the entire periphery of each control cam (and the teeth on the code cams being spaced accordingly), each step advance would be 7.5°. Upon completion of each advance step, a return spring resets the input shaft 12, 16, associated pawl driver and pawl to its original position for another advance stroke; and a backstop pawl associated with each control cam and each code cam prevents reverse rotation of the control and code cams. In the embodiment of FIG. 1*a*, the return springs 72 and 74 are mounted, respectively, between ground locations and shafts 12 and 16. Representative spring loaded backstop pawls 76 and 78 are shown in FIG. 1*b*. Return stops 80 and 82 limit the return movement of pawl drivers 18 and 20 to ensure that the pawl units are properly reset for the next forward or advance stroke.

Output cams 58 and 64 have unlock or actuation notches or contours 68 and 70, respectively, in the periphery of the cams. The notches are similarly sized and shaped. Notches 68 and 70 are aligned when the unit is initially set or reset to the SAFE (locked) state (sometimes referred to as "home"); and the notches will remain aligned as the unit advances from the SAFE to the ARMED (unlocked) state as long as the correct code is delivered in the correct sequence to go from the SAFE to the ARMED state. However, if an incorrect code signal is delivered to the unit at any place in the code sequence between the SAFE and ARMED states, the notches will be moved out of alignment so that unlocking or other activation cannot occur.

The maintenance or loss of the state of alignment between the notches occurs as the result of movement and interaction of the input control cams 26, 30 and the input code cams 28, 32. A string of coded "0" and "1" bit digital signals is used to move the device from a starting SAFE state to an ARMED state. The "0" signals in the string are delivered as pulses to operate solenoid driver 10, and the "1" signals are delivered as pulses to operate solenoid driver 14. If the correct code string is delivered to the system, each "0" bit will advance both the control cam 26 and the "0" bit code cam 28; and, each "1" bit will advance both control cam 30 and "1" bit code cam 32. Each step advance of a control cam will cause a step advance rotation of output gear 50 and output cam 58; and each step advance of either code cam 28 or code cam 32 will cause a step advance rotation of output gear 60 and output cam 64. Thus, for each inputted code bit (whether a "0" or a "1" bit and whether or not it is a correct bit for the code), control output cam 58 will advance one step; and for each correct "0" or "1" bit, code output cam 64 will also advance one rotational step. Thus, if the correct code is inputted, the output cams 58 and 64 will advance in unison, and the notches 68 and 70 will remain aligned or synchronized. Then, upon inputting of the complete correct code, the output cams 58, 64 will rotate to a position where the notches 68, 70 are aligned with a mechanism such as a roller 84, and the roller will be permitted to move into notches 68, 70. As illustrated in FIG. 1*b*, the roller mechanism 84 is normally (i.e. in the SAFE condition) engaged and retained by the outer surface of output cams 58, 64 in a notch 86 in a part 88 of a device or system to be operated, to thus lock the part 88 against movement or activation. However, when both notches 68, 70 align with roller 84 and notch 86, roller 84 is permitted to move out of notch 86 and into notches 68, 70. Thus, roller 84 disengages from part 88, whereby part 88 is unlocked and is free to move, to operate a weapon or other system, i.e. the part 88 and its associated weapon or system are switched to an ARMED state.

It should be noted that each step rotary advance of either "0" code cam 28 or "1" code cam 32 will, through the gears 44, 60 and 48, cause a step rotary advance of the other code wheel. Thus, both code cams advance with each correct code input signal so that the ratchet teeth on the code cam are always properly positioned to receive a next correct input signal, as long as the input signal string is in the correct code sequence.

If an incorrect code is delivered to the system, the above described sequence will not occur, and unlocking to switch from a SAFE to an ARMED state will not occur. To illustrate this point, assume that a "0" bit is delivered to the system at a point in the code string where a "1" is correct. The erroneous "0" will operate solenoid 10 and effect a one step rotary advance of shaft 12, pawl arm 18 and "0" bit pawl 22. This one step advance or cycling of pawl 22 will cause a one step advance of "0" control cam 26 (because the pawl will be engaged with a ratchet tooth 34 on cam 26). Accordingly, as described above, there will also be a one step rotary advance of control output cam 58. However, since there will be no ratchet tooth on "0" code cam 28 at this position on the code cam, the advance or cycling of pawl 22 will not effect a step advance of code cam 28. Since code cam 28 does not advance, both gear 60 and code output cam 64 will remain stationary. As a result, control output cam 58 rotates relative to code output cam 64 to misalign or desynchronize the unlock notches 68, 70. Since the notches 68, 70 are now out of alignment, continued rotations of the output cams 58, 64 in step fashion in response to further code input signals will not result in unlocking of part 88, because notches 68, 70 will not be aligned to receive unlock roller 84.

An important point to be noted is that the presence of an incorrect code bit does not provide any feedback to indicate that an incorrect code input has been made. At and after the input of an incorrect code bit, the system continues to advance in step rotary increments, but with the unlock notches misaligned. If an intruder is attempting to effect unauthorized operation of the system, the intruder will not be informed when an erroneous bit has been inputted. Thus, the intruder will not be able to work through the system by repeating previous inputs and correcting an erroneous input when it occurs, because the intruder will not be informed when an erroneous bit has been inputted.

The code and control cams all rotate in the same direction for advancing steps, and the output cams rotate in the opposite direction to that of the input cams. The same sense of rotation of the code and control cams makes it possible to connect the cams through output gears 50 and 60. This is important to ensure that the code cams remain properly synchronized.

While a reset mechanism can be provided to reset the entire system to the start position, a reset mechanism has not been shown in FIG. 1*a* to simplify the showing and explanation of the system. However, suitable reset mechanisms are shown in FIGS. 2 through 5

Figure 2A:
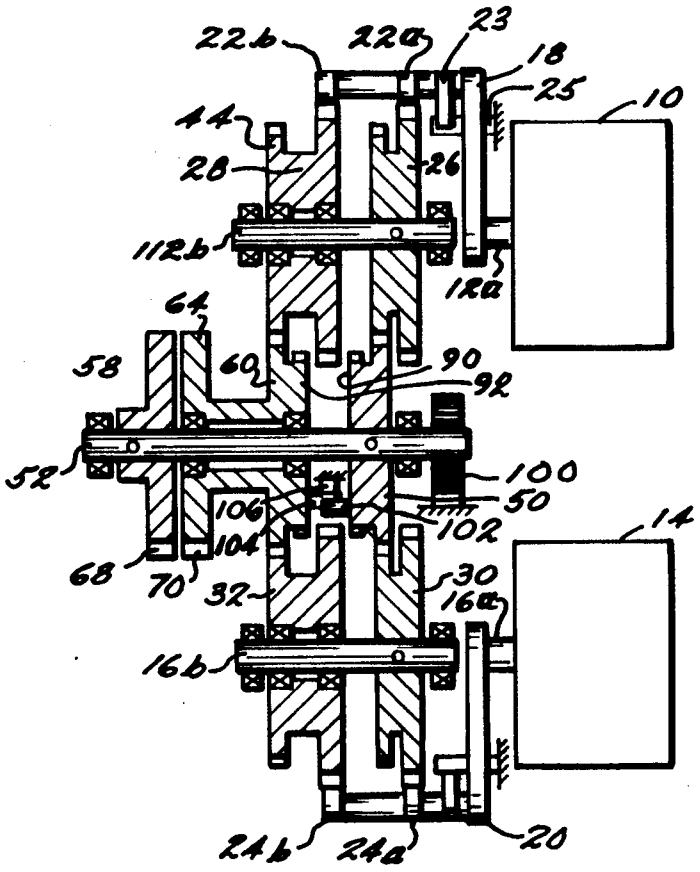
FIG. 2*a* is an illustration similar to FIG. 1*a* of a second version of the invention
Figure 2B:
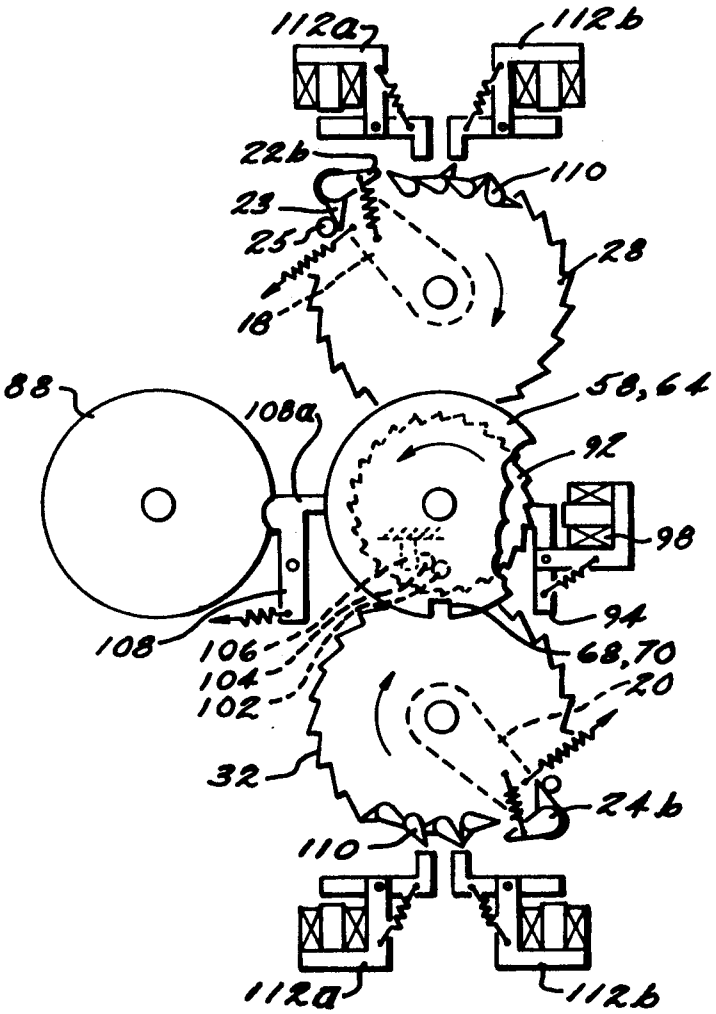
FIG. 2*b* is an illustration of the relationship of input and output cams of the device of FIG. 2*a*
Figure 3:
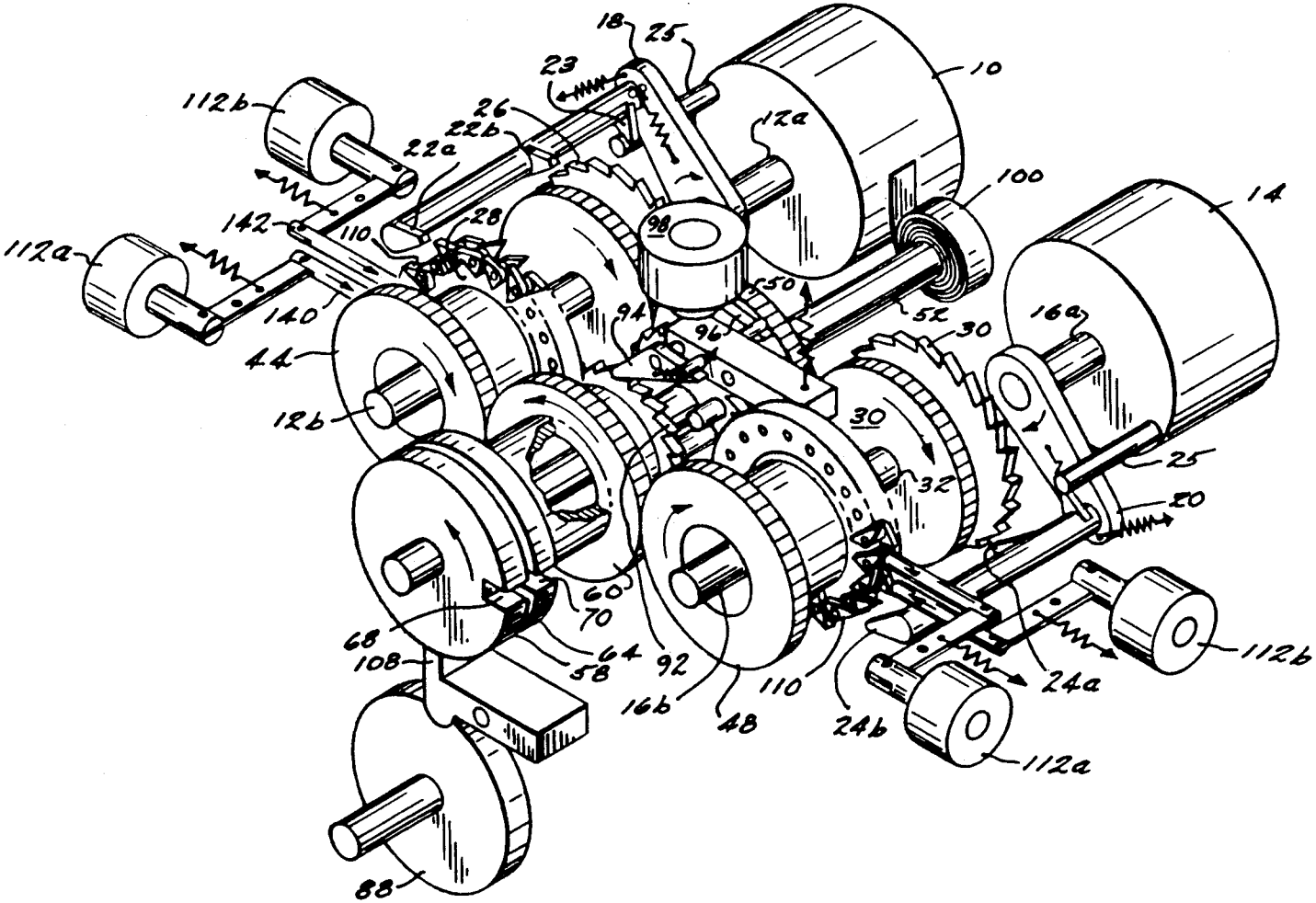
FIG. 3 is an isometric view of the device illustrated in FIGS. 2*a* and 2*b*

Referring now to FIGS. 2*a*, 2*b* and 3, a second embodiment of the secure code operated device of the present invention is shown. The primary differences between this second embodiment and that of the first embodiment are:

(1) the presence of ratchet wheels 90, 92 with peripheral teeth on the output gears 50 and 60; and
(2) a pair of backstop pawls 94, 96 (only one of which is shown in FIG. 2*b*), operatively associated, respectively, with the ratchet wheels 90, 92.
(3) a reset solenoid 98 operable to release the backstop pawls 94, 96 to permit the unit to be reset to a starting position
(4) a return spring 100 which, when reset solenoid 98 is activated to withdraw the backstop pawls 94, 96, is effective to return all input and output control and code cams to their starting position (wherein unlock notches 68, 70 are aligned)
(5) return stops 102 and 104 on gears 50 and 60 which will contact a grounded stop element 106 when the cams have all returned to their starting positions
(6) a spring loaded unlock lever 108 with finger 108*a* instead of roller 84
(7) resettable or programmable ratchet teeth 110 on code cams 28 and 32 and ratchet tooth resetting solenoids 112*a*, 112*b* (all of which will be described in more detail in connection with FIGS. 6 and 7).

It will be noted that in this second embodiment, shafts 12 and 16 are each split into two independent segments 12*a*, 12*b*, 16*a* and 16*b*. The pawl arms 18 and 20 are connected to shaft segments 12*a* and 16*a*, but the control and code cams 26, 28, 30, and 32 are mounted on separate shaft segments 12*b* and 16*b*. The drive pawls are split into segments 22*a*, 22*b* on a common shaft which drive control cam 26 and code cam 28 in unison (assuming a correct code), and segments 24*a*, 24*b* on a common shaft which drive control 30 and code cam 32 in unison (assuming a correct code). The control cams 26, 30 are fixed to shaft segments 12*b* and 16*b*, while the code cams 28, 32 are rotatably mounted on the shaft segments.

Except for the resetting function and the programmable ratchet teeth, the embodiment FIGS. 2*a*, 2*b* and 3 operates in the same manner as the first embodiment of FIGS. 1*a*, 1*b* and 1*c*. A correct "0" bit input to driver solenoid 10 will cause step movement of drive pawls 22*a* and 22*b* to step advance control cam 26 and code cam 28. Similarly, a correct "1" bit input to driver solenoid 14 will cause step movement of drive pawls 24*a* and 24*b* to step advance control cam 30 and code cam 32. If the correct coded sequence of "0" and "1" inputs is delivered to the unit, the output gears 50, 60 and the control and code output cams 58 and 64 will rotate in synchronism to keep output control cam notch 68 and the output code cam notch 70 in alignment. Delivery of the complete correct code will rotate the control and code output cams 58, 64 to the position where finger 108*a* of output lever 108 moves into the aligned notches 68, 70 to unlock the locked device 88. However, if an incorrect "0" or "1" bit is inputted, output gear 50 and output control cam 58 will rotate, but output gear 60 and output code cam 64 will not rotate, thus desynchronizing notches 68 and 70 to prevent actuation of lever 108 and prevent unlocking of device 88.

As with the unit of FIGS. 1*a* and 1*b*, the intruder who entered the erroneous code will not receive any feedback of the error. At and after the input of the incorrect code bit, the system continues to advance in step rotary increments, but with the unlock notches misaligned and with the occurrence of the misalignment unknown to the intruder. The system may be reset to the start or home position for code input by operating reset solenoid 98 which disengages backstop pawls 94, 96 from ratchet wheels 90, 92, whereby return spring then drives the gears and cams in the reverse direction to reset everything to the start position to await input of the correct coded sequence.

It will be noted that drive pawls 22*a*, 22*b*, 24*a*, 24*b* are all pivotal on their respective pawl drivers 18, 20; and they are spring loaded so that they rotate inwardly into position to engage the cam teeth when the pawl drivers advance. Each drive pawl has a lever segment 23 which engages a stop 25 when the pawl driver is returned to its rest position to rotate the drive pawl outwardly beyond the cam teeth. This enables the code and control cams to be rotated in the reverse direction by return spring 100 if reset solenoid 98 is activated.

Figure 4A:
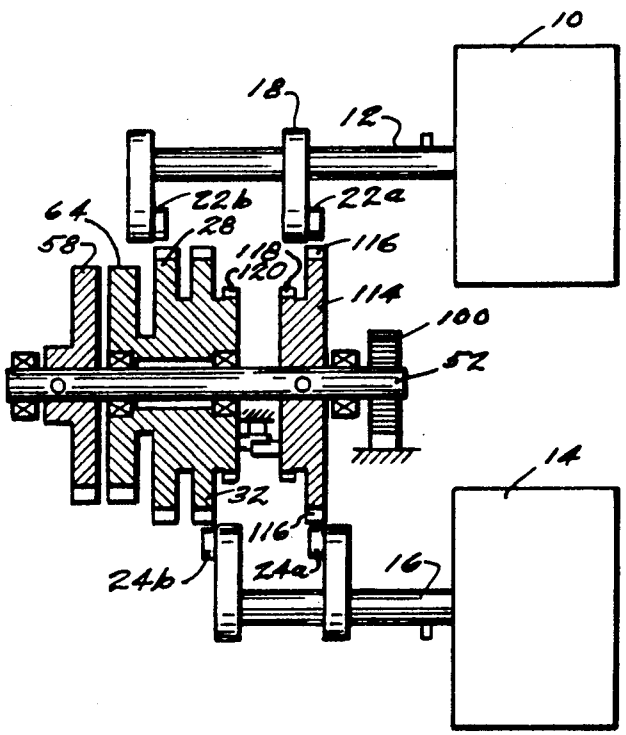
FIG. 4*a* is a view similar to FIG. 1*a* of a third version of the invention
Figure 4B:
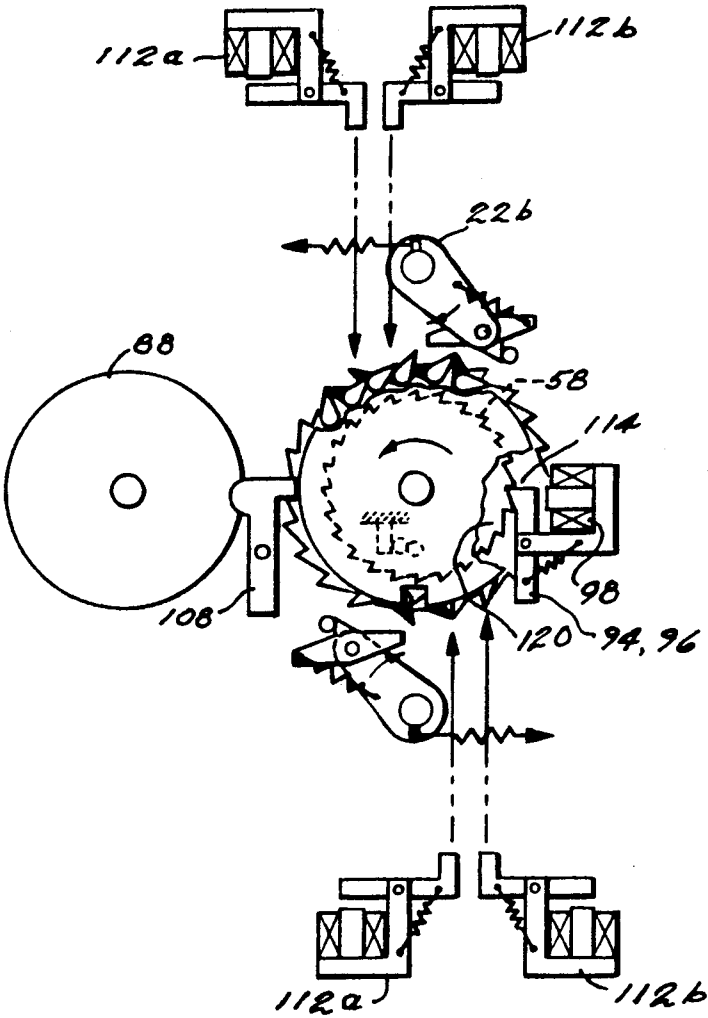
FIG. 4*b* is an illustration of input and output cams of the device of FIG. 4*a*
Figure 5:
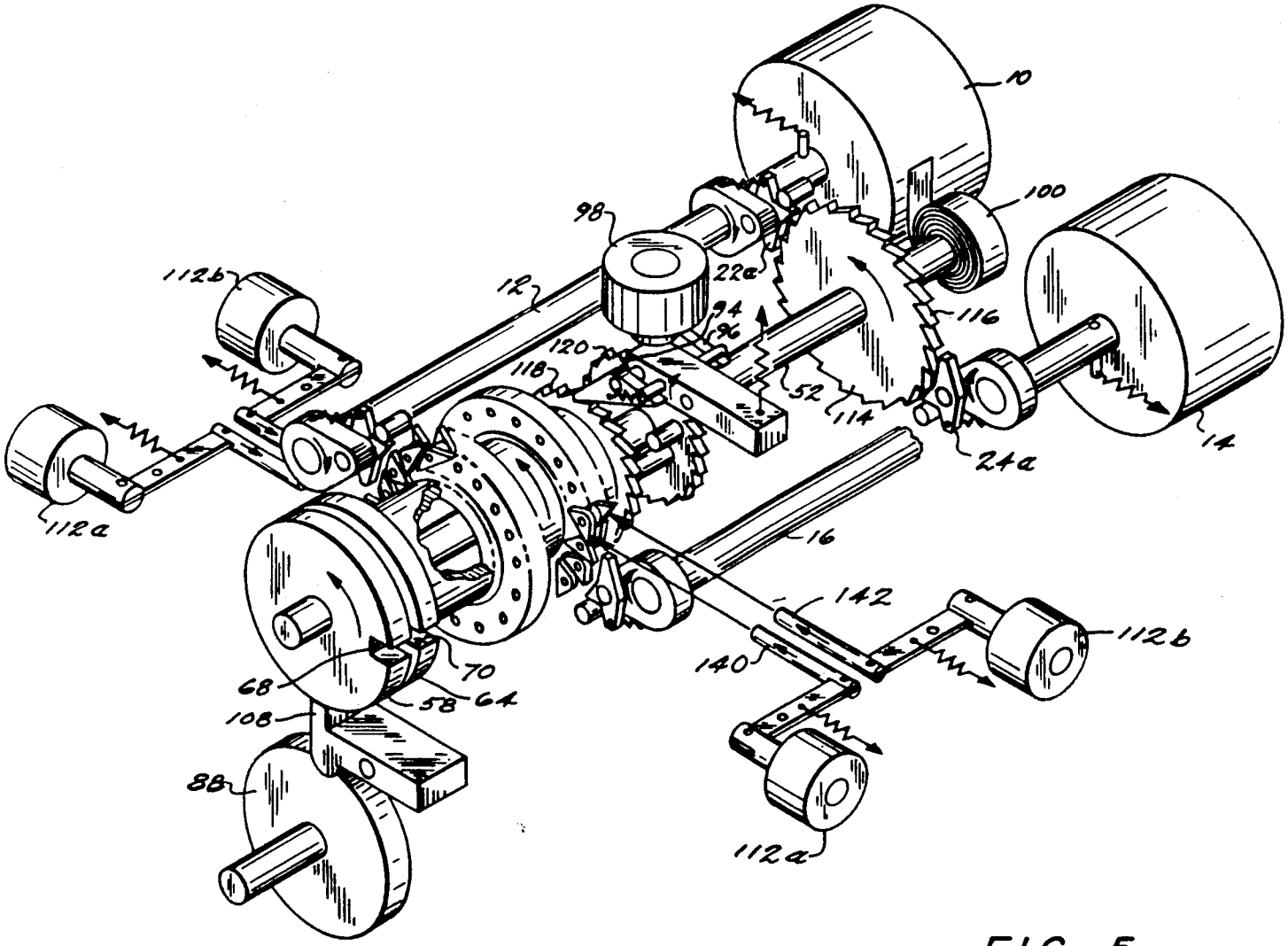
FIG. 5 is an isometric view of the device shown in FIGS. 4*a* and 4*b*

Referring now to FIGS. 4*a*, 4*b* and 5, a third embodiment is shown. This embodiment differs from the second embodiment in that (1) A single common input control cam 114 is mounted directly on and fixed to output shaft 52. This single input control cam has ratchet teeth 116 which are engaged by pawls 22*a* and 24*a*. Backstop pawl 94 interacts with a ring of ratchet teeth on a reduced diameter part of the control cam.
(2) Input code cams 28 and 32 are combined in a single cam body which is mounted directly on and is rotatable on output shaft 52. Code cam 28 is driven by pawl 22*b*, and code cam 32 is driven by pawl 24*b*. Backstop pawl 96 interacts with a ring of ratchet teeth 120 on a reduced diameter part of the control cam.
(3) Code output cam 64 is formed as an integral part of the united code cam 28, 32.

The system of FIG. 5 mounts the input cams directly on the output shaft 52, and eliminates the gearing of the first and second embodiments. The single input control cam is fastened to shaft 52, while the code cams 28, 32 are rotatable on shaft 52. Code output cam 64 is rotatable on shaft 52, and control output cam 58 is fastened to shaft 52.

The system of the third embodiment operates in the same way as the system of the first and second embodiments. However, it will be understood that all control inputs, whether accompanying a "0" code input or a "1" code input, are delivered to, and drive, the single control input cam 114.

Figure 6:
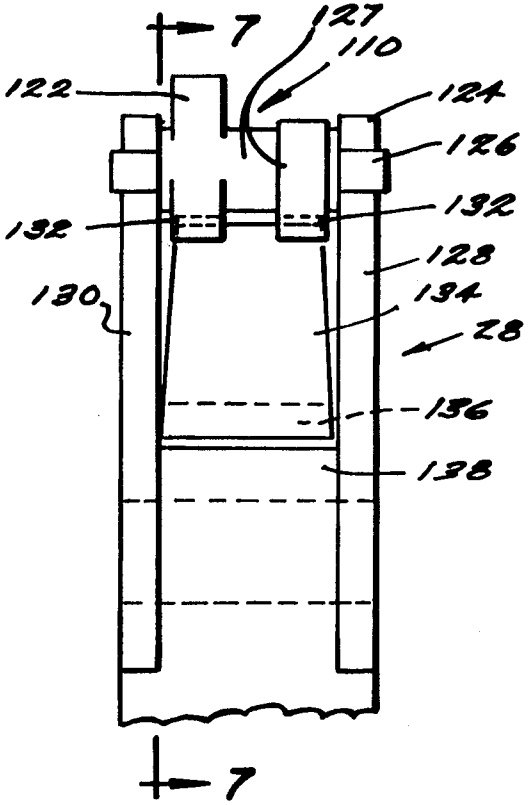
FIG. 6 shows an enlarged detail of resettable or programmable teeth on a code cam.
Figure 7:
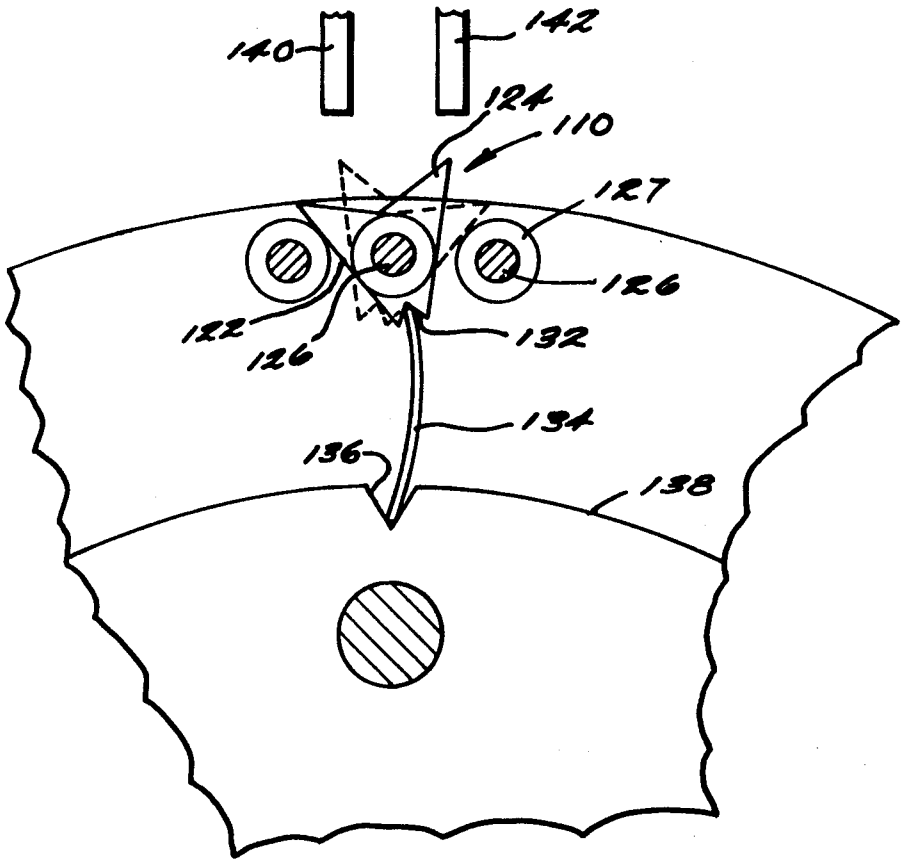
FIG. 7 is a view along line 7—7 of FIG. 6.

Referring now to FIGS. 6 and 7, enlarged partial details are shown of the resettable or programmable ratchet teeth 110 on the code cams. Programmable teeth 110 are made up of tooth segments 122, 124, both of which are secured on and rotate simultaneously with a shaft 126. Each tooth segment 122, 124 is generally diamond shaped and extends from a cylindrical body portion 127. The body portions 127 are secured to shaft 126 by any convenient means. Shaft 126 is pivotally supported in spaced disc members 128, 130 on the outer periphery of a code cam, e.g., cam 28. The lower or inner end of each tooth segment has a "V" notch 132 which receives one end of a toggle or overcenter leaf spring 134. The other end of spring 134 is retained in a V notch 136 in an inner peripheral surface 138 of the code cam. Spring 134 functions to keep a tooth 110 in either the full or dashed line position shown in FIG. 7 after the tooth has been moved to the selected position by setting fingers 140, 142 which are actuated by the code setting solenoids 112*a* and 112*b*. The dashed line position of the tooth 110 in FIG. 7 corresponds to the "up" or "set" position of the tooth where it is in the position to be engaged by a pawl driver to advance the associated code cam; the solid line position corresponds to the "down" or "recessed" position where the tooth 110 is positioned so that the pawl driver will pass over the tooth without engaging the tooth and without advancing the code wheel. A programmable tooth 110 is switched from the full line position of FIG. 7 to the dashed line position by actuating finger 142 to engage tooth segment 124 to rotate tooth 110 clockwise to the dashed line position. Conversely, a tooth 110 is moved from the dashed position to the full line position by actuating finger 140 to engage tooth segment 122 to rotate tooth 110 counterclockwise to the full line position. When a tooth is moved to either the "up" or "down" position, it is stopped on the cylindrical surface of the adjacent tooth and held in position by the overcenter spring 134. For convenience of illustration, only one full tooth is shown in FIG. 7, and only the cylindrical portions 127 and shafts 126 of the adjacent teeth are shown. Also, it will be understood that while only three tooth positions are shown in FIG. 7, the teeth will extend around the full periphery of the cam (or an arc segment thereof if only part of the cam has coded teeth).

It will be understood that when a programmable tooth on one code cam (e.g., the "1" cam) is set to the "up" position, the corresponding or complementary tooth on the other cam (e.g., the "0" cam) must be in the "down" position. The actuating solenoids 112*a*, 112*b* are programmed to receive the appropriate actuating signals to establish and maintain the desired relationship among the programmable teeth.

As an alternative to the leaf spring toggle mechanism shown in FIGS. 6 and 7, an over center ball detent mechanism, or any other suitable toggle mechanism, can be employed to hold the teeth in the "up" or "down" positions. When the programmable teeth are used, the pawl driver which engage the "up" teeth must be sized to be of a width (i.e., in the axial direction of the code cam) just equal to the width of the tooth segment in the "up" position. Also, when programmable teeth are used, access to the code setting solenoids 112*a*, 112*b* should, preferably, be protected or restricted by a secure coding device of the present invention to prevent an intruder from gaining access to the system to set his own code.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A code operated device including:

code means for storing a predetermined code;

control means operatively associated with said code means;

actuating means for delivering a plurality of input signals to said code means and to said control means, said control means responding to each of said input signals and said code means responding only to input signals which correspond to said predetermined code;

first output means operatively connected to said code means, said first output means including first actuator means to perform an output function only when properly synchronized with a second actuator means;

second output means operatively connected to said control means, said second output means including the second actuator means to perform an output function when properly synchronized with said first actuator means;

said first and second actuator means being synchronized when the plurality of input signals delivered to said code means corresponds to said predetermined code, and said first and second actuator means being desynchronized when the plurality of input signals delivered to said code means does not correspond to said predetermined code.

2. A code operated device as in claim 1 wherein:

said code means includes first and second code elements each of said code elements storing a part of the predetermined code, said first and second code elements each being operatively connected to said first output means.

3. A code operated device as in claim 1 including:

means to reset said code means, said control means, and said first and second output means to a home position.

4. A code operated device as in claim 1 including:

code setting means operatively associated with said code means to select or change a predetermined code.

5. A code operated device including:

code cam means for storing a predetermined code, said code cam means being mounted for rotation;

control cam means operatively associated with said code cam means, said control cam means being mounted for rotation;

actuating means for delivering a plurality of input signals to rotate said code cam means in steps and to rotate said control cam means in steps, said control cam means being actuated in response to each input signal and said code cam means being actuated only in response to input signals which correspond to said predetermined code;

first output code means operatively connected to said code cam means, said first output code means including first signal means to generate an output signal only when properly synchronized with a second signal means;

second output control means operatively connected to said control cam means, said second output control means including the second signal means to generate an output signal when properly synchronized with said first actuator means;

said first and second signal means being synchronized when the plurality of input signals delivered to said code cam means corresponds to said predetermined code, and said first and second signal means being desynchronized when the plurality of input signals delivered to said code cam means does not correspond to said predetermined code.

6. A code operated device as in claim 5 wherein:

said code cam means includes first and second code cams, each of said first and second code cams being mounted for rotation and storing a part of the predetermined code, said first and second code cams each being operatively connected to said first output means.

7. A code operated device as in claim 5 wherein:

said code cam means includes first and second code cams, each of said first and second code cams being mounted for rotation and storing a part of the predetermined code, said first and second code cams each being operatively connected to said first output means;

said control cam means includes first and second control cams mounted for rotation, said first control cam being operatively associated with said first code cam and said second control cam being operatively associated with said second code cam;

said first and second code cams each being operatively connected to said first output code means; and said first and second control cams each being operatively connected to said second output control means.

8. A code operated device as in claim 5 including:

means to reset said code cam means, said control cam means, said first output code means and said second output control means to a home position.

9. A code operated device as in claim 5 including:

code setting means operatively associated with said code cam means to select or change a predetermined code.

10. A code operated device including:

code cam means having a plurality of coded teeth at the peripheral surface thereof, said code cam means being rotatably mounted on a shaft;

control cam means having a plurality of equally spaced teeth at the peripheral surface thereof, said control cam means being rotatably mounted on a shaft;

actuating means for delivering a plurality of input signals to the teeth on said code cam means and to the teeth on said control cam means to rotate said code cam means and said control cam means in steps, said control cam means being actuated in response to each input signal and said code cam means being actuated only in response to input signals which correspond to said predetermined code;

first output code cam means operatively connected to said code cam means, said first output code cam means being rotatably mounted on a shaft and rotating in steps commensurate with the step rotation of said code cam means;

said first output code cam means including first signal means to generate an output signal only when properly synchronized with a second signal means;

second output control cam means operatively connected to said control cam means being rotatably mounted on a shaft and rotating in steps commensurate with the step rotation of said control cam means, said second output control means including the second signal means to generate an output signal when properly synchronized with said first actuator means;

said first and second signal means being synchronized when the plurality of input signals delivered to said code cam means corresponds to said predetermined code, and said first and second signal means being desynchronized when the plurality of input signals delivered to said code cam means does not correspond to said predetermined code.

11. A code operated device as in claim 10 wherein:

said code cam means includes first and second code cams, each of said first and second code cams being mounted for rotation and storing a part of the predetermined code, said first and second code cams each being operatively connected to said first output means.

12. A code operated device as in claim 10 wherein:

said code cam means includes first and second code cams, each of said first and second code cams being mounted for rotation and storing a part of the predetermined code, said first and second code cams each being operatively connected to said first output means;

said control cam means includes first and second control cams mounted for rotation, said first control cam being operatively associated with said first code cam and said second control cam being operatively associated with said second code cam;

said first and second code cams each being operatively connected to said first output code means; and said first and second control cams each being operatively connected to said second output control means.

13. A code operated device as in claim 10 including:

means to reset said code cam means, said control cam means, said first output code means and said second output control means to a home position.

14. A code operated device as in claim 10 including:

code setting means operatively associated with said code cam means to select or change a predetermined code.

15. A code operated device as in claim 10 wherein:

said code cam means includes a first code cam rotatably mounted on a first shaft and a second code cam rotatably mounted on a second shaft, said first code cam having coded teeth at a peripheral surface thereof storing a first part of said predetermined code and said second code cam having coded teeth at a peripheral surface thereof storing a second part of said predetermined code; and said control cam means includes a first control cam rotatably mounted on said first shaft, and a second control cam rotatably mounted on said second shaft, each of said first and second control cams having equally spaced teeth at a periphery thereof;

and further including:

first gear means connecting said first and second code cam means to said first output code cam means; and second gear means connecting said first and second control cam means to said output control cam means.

16. A code operated device as in claim 15 wherein:

said first and second gear means, said first output code cam means and said second output control cam means are all rotatably mounted on a third shaft.

17. A code operated device as in claim 16 wherein:

said first code cam and said first control cam are rotatable with respect to said first shaft;

said second code cam and said second control cam are rotatable with respect to said second shaft; and said first gear means and said output code cam are rotatable with respect to said third shaft, and said second gear means and said output control cam are fixed with respect to said third shaft.

18. A code operated device as in claim 16 wherein:

said first code cam is rotatable with respect to said first shaft, and said first control cam is fixed with respect to said first shaft;

said second code cam is rotatable with respect to said second shaft, and said second control cam is fixed with respect to said second shaft; and said first gear means and said output code cam are rotatable with respect to said third shaft, and said second gear means and said output control cam are fixed with respect to said second shaft.

19. A code operated device as in claim 10 wherein:

said code cam means includes first and second code cams mounted on a rotatable shaft;

said control cam means is mounted on said shaft; and said output code cam and said output control means are mounted on said shaft.

20. A code operated device as in claim 19 wherein:

said first and second code cams and said output code cam are on a single cam body.

21. A code operated device as in claim 20 wherein:

either said single cam body or said control cam and output control cam is rotatable relative to said shaft and the other is fixed relative to said shaft.

22. A code operated device as in claim 20 wherein:

said single cam body, said first and second code cams and output control cam are rotatable relative to said shaft; and said control cam means and said output control cam are fixed relative to said shaft.

23. A code operated device including:

code means for storing a predetermined code, said code means including first and second code elements and each of said code elements storing a part of the predetermined code;

control means including first and second control elements, said first control element being operatively associated with said first code element and said second control element being operatively associated with said second code element;

actuating means for delivering a plurality of input signals to said code means and to said control means, said control means responding to each of said input signals and said code means responding only to input signals which correspond to said predetermined code;

first output means operatively connected to said first and second code elements, said first output means including first actuator means to perform an output function only when properly synchronized with a second actuator means;

second output means operatively connected to said first and second control elements, said second output means including the second actuator means to perform an output function when properly synchronized with the first actuator means;

said first and second actuator means being synchronized when the plurality of input signals delivered to said code means corresponds to said predetermined code, and said first and second actuator means being desynchronized when the plurality of input signals delivered to said code means does not correspond to said predetermined code.

* * * * *